US009956445B2

(12) United States Patent
Enk, Sr.

(10) Patent No.: US 9,956,445 B2
(45) **Date of Patent: *May 1, 2018**

(54) FIRE SUPPRESSION SYSTEM

(71) Applicant: William Armand Enk, Sr., Key Largo, FL (US)

(72) Inventor: William Armand Enk, Sr., Key Largo, FL (US)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/161,719

(22) Filed: May 23, 2016

(65) Prior Publication Data

US 2016/0263410 A1 Sep. 15, 2016

Related U.S. Application Data

(63) Continuation-in-part of application No. 14/641,055, filed on Mar. 6, 2015, now Pat. No. 9,381,388, which (Continued)

(51) Int. Cl.

| | |
|---|---|
| ***A62C 5/02*** | (2006.01) |
| ***A62C 35/02*** | (2006.01) |
| ***A62C 35/11*** | (2006.01) |
| ***A62C 35/13*** | (2006.01) |
| ***A62C 3/08*** | (2006.01) |
| ***B05B 12/08*** | (2006.01) |
| ***B05B 1/18*** | (2006.01) |
| ***A62C 99/00*** | (2010.01) |
| *A62C 3/07* | (2006.01) |

(52) U.S. Cl.

CPC ..... *A62C 5/024* (2013.01); *A62C 3/08* (2013.01); *A62C 5/02* (2013.01); *A62C 35/023* (2013.01);

(Continued)

(58) Field of Classification Search

CPC .... A62C 3/07; A62C 3/08; A62C 3/10; A62C 5/02; A62C 5/022; A62C 5/024; A62C 5/027; A62C 13/66; A62C 13/68; A62C 13/70; A62C 13/72; A62C 13/74; A62C 31/12; A62C 35/02; A62C 35/023; A62C 37/10; A62C 37/11; A62C 37/38; A62C 37/40; A62C 37/44; A62C 99/0036; B05B 12/087

See application file for complete search history.

(56) References Cited

U.S. PATENT DOCUMENTS 3,174,550 A 3/1965 Bugg
4,351,394 A 9/1982 Enk (Continued)

*Primary Examiner* — Darren W Gorman

(74) *Attorney, Agent, or Firm* — Husch Blackwell LLP

(57) ABSTRACT

A fire suppression system for a fire zone including a first tank containing a first liquid component of a two-part foam and a second tank containing a second liquid component of the foam. The system includes at least one liquid component release device configured to be selectively capable of releasing the first and second components from their respective containers upon receipt of a signal from a fire detector upon detection of a fire. The two-part foam components are propelled through the system by a pressurized propellant that, upon release of the release device, causes the exit of the foam components from their respective tanks, through a mixing conduit to at least one nozzle. The nozzle is configured to spray the liquid component foam mixture into the fire zone wherein the foam cures into a substantially semi-rigid, closed cell foam that is substantially impermeable and may have charring and/or intumescence properties.

31 Claims, 11 Drawing Sheets

Related U.S. Application Data is a continuation of application No. 13/336,298, filed on Dec. 23, 2011, now Pat. No. 8,973,670.

(60) Provisional application No. 61/428,614, filed on Dec. 30, 2010, provisional application No. 61/433,313, filed on Jan. 17, 2011.

(52) U.S. Cl.
CPC ..... *A62C 99/0036* (2013.01); *B05B 1/185* (2013.01); *B05B 12/087* (2013.01)

(56) References Cited

U.S. PATENT DOCUMENTS

| | | | | |
|---|---|---|---|---|
| 4,566,542 | A | 1/1986 | Enk et al. | |
| 4,779,683 | A | 10/1988 | Enk | |
| 4,981,178 | A | 1/1991 | Bundy | |
| 7,163,642 | B2 | 1/2007 | Hagquist et al. | |
| 7,334,644 | B1 | 2/2008 | Ozment | |
| 2006/0219416 | A1 | 10/2006 | Fore et al. | |
| 2008/0168798 | A1 | 7/2008 | Kotliar | |
| 2008/0314602 | A1 | 12/2008 | Lohnes | |
| 2009/0084561 | A1 | 4/2009 | Popp et al. | |
| 2010/0025053 | A1 | 2/2010 | Chesley | |
| 2013/0307270 | A1* | 11/2013 | Steen | F03D 80/00 290/44 |

* cited by examiner

FIRE SUPPRESSION SYSTEM

CROSS-REFERENCE TO RELATED APPLICATIONS

This application is a continuation-in-part of and claims priority to U.S. patent application Ser. No. 14/641,055, filed on Mar. 6, 2015 to William A. Enk, Sr. entitled "Fire Suppression System," currently pending, which is a Continuation of and claims priority to U.S. patent application Ser. No. 13/336,298, filed on Dec. 23, 2011 to William A. Enk, Sr. entitled "Fire Suppression System," now issued as U.S. Pat. No. 8,973,670, which claims priority to U.S. Provisional Patent Application No. 61/428,614 having a filing date of Dec. 30, 2010, and U.S. Provisional Patent Application No. 61/433,313 having a filing date of Jan. 17, 2011. The entire disclosures, including the specifications and drawings, of all above-referenced applications are incorporated herein by reference.

BACKGROUND OF THE INVENTION

A notice of proposed rulemaking has been issued by U.S. DOT that may require one or more of several additional measures to protect aircraft against lithium battery fires. It is expected to become law in 2012. The new law may have a short time of compliance, in fact the proposed rule states the time of compliance will be only seventy-five days.

There is a need for air freight carriers to convert their lower deck cargo compartments of their airplanes to Class C compartments by providing them with a FAA approved smoke detection and fire suppression system. In addition, many air freight carriers seek an alternative solution that is capable of providing fire protection everywhere in the cargo compartments of their air carrier aircraft fleet. Obviously, everywhere includes in the main cargo area as well as in the lower lobe cargo compartments. In all of these cargo compartments may be Unit Load Devices (ULDs) and pallets—which can be covered with blankets or nets, hereinafter all referred to as "ULDs."

It would therefore be beneficial to have a traditional fire suppression system ("FPS") for the lower deck cargo compartments, and an additional solution to be used in conjunction or separately with the traditional (i.e. Halon) FPS used on these aircraft.

Earlier fire suppression devices often employ gaseous, liquid, or water-based foam products that are released into the cargo hold or individual freight containers (ULDs for example), and are usually intended to: 1) cover the burning cargo inside the ULD and create an oxygen-depriving medium (for example a foam system used and owned by Federal Express), 2) create an inert atmosphere inside the ULD, as with the Vulcan or Halon/Halon Replacement gaseous extinguishing systems, 3) create a cooling medium, such as provided by water misting technology, or 4) retard a fire's propagation.

As applied to cargo carried on aircraft, the earlier methods relied upon the ULD containing a foam, gas, protected structure, or water-mist system. Some agents proposed in earlier methods have properties which are toxic, corrosive, subject to freezing, have short-lived durations of protection (usually due to the inability of the ULD to sufficiently overcome leakage) or have a combination of these characteristics, all detracting from a reliable and simple method of controlling fires likely to occur today in a ULD.

Most early foam suppression systems operate on the principle that oxygen deprivation or suffocating the fire is sufficient to extinguish a fire. There are cases, however, where a fire is too strong and oxygen deprivation and suffocation simply is not enough. In addition, once depressurization of the aircraft occurs the necessary amount of foam or gas mixture may leak out, or be forced out, of the aircraft and therefore not sufficiently extinguish the fire; and/or when the aircraft descends the air density inside will again be sufficient to support a fire. Accordingly, there is a need in the art to provide oxygen deprivation but offer a system that will, in addition, substantially seal off the fire and fight the fire through char formation and/or intumescence chemical action.

Earlier fire suppression systems generally employ a means within or from the ULD's to interface with the aircraft systems and/or the operational personnel. Some early fire suppression systems provide merely a means to warn the crew of a fire and others allow the crew some control the ULDs fire suppression device and the response of the related fire suppression systems.

None of the earlier crew interface means provide protection of the interface device that detects the fire and communicates with the crew from explosions and projectiles capable of damaging the interface device; thus, preventing the interface means from performing its intended functions. Therefore, there is a need in the art to provide a fire suppression system that is protected against explosions and projectiles.

Moreover, weight, volume, and the cost to maintain products in airworthy condition are all critical in air freight operations. Earlier proposed fire suppression systems included adding the fire suppression means in all of the ULDs or throughout the aircraft itself. In other words, a built-in solution. However, these proposed systems are not optimal because they add unnecessary weight to the overall load of the air freight plane because the additional fire protection may not be needed for all freight depending on type. The proposed earlier fire suppression systems add about sixty (60) pounds to each ULD carried by the air freight planes used. Thus, there is a need in the art for a fire suppression system that weighs less than sixty (60) pounds, and/or can be selectively placed in ULD's that pose an increased risk of a fire not suppressible with standard fire suppression systems. Further, there are also no standards or practices to determine, before each use, the airworthiness of a ULD with such added fire suppression means.

Built-in systems also pose cost and reliability concerns. The costs to develop, certify, and maintain built-in systems are often substantial. The reliability of some of these devices and/or built-in systems is unknown unless developed and analyzed simultaneously with a proper Safety Assessment.

ULDs are typically subject to very rough treatment and storage conditions. To Applicant's knowledge, there are currently no discussions, procedures, or instructions to evaluate ULD normal wear and tear on the ability of the means to perform its intended function. There are no standards directed to repair and service of ULDs or about the minimum equipment list (MEL) dispatch requirements for a fire suppression means, the ULDs, or aircraft containing the ULDs and the fire suppression means. Fires are not likely to occur outside of the ULDs located in the main and lower lobe compartments because the freight is only located in these ULD containers. Thus, the source of a fire is most likely to be the freight inside of the ULD, and often the risk may be limited to only a few ULDs on each carrier that contain materials, such as lithium batteries, that pose substantial and unique fire threats.

Similar, pallets or boxes in trailers of one of the millions of over-the-road tractors may include materials that pose a fire risk. Thus, there is a need in the art for a fire suppression system that can be configured to be installed in the trailers of semi-trucks to protect the cargo and contents of the trailer. Further, as more and more cars and trucks are being offered with a hybrid or all electronic drive systems, there is a concern of the battery bundles being ignited and burning after a crash, a particular shortcoming has been observed in side impact collisions. Once the lithium (or other long range) batteries are exposed or broken, there is the chance of spontaneous ignition and the fires of these metals are very difficult to extinguish. Thus, there is a need in the art for a fire suppression system that can adequately contain and extinguish such a fire in over-the-road trailers and the battery enclosures of hybrid or electric cars.

There are three (3) phases of a fire—the incipient phase, the visible smoke phase, and the heat and flame phase. The most reliable and effective fire protection systems are those which deploy in the early phases of a fire. Otherwise, a fire is much more difficult to bring under control and it causes much more damage once the fire is in the heat and flame phase.

Since depressurizing the cargo compartment(s) of a freighter aircraft is one traditional means to suppress a fire, the traditional fire suppression system (Halon) cannot be activated until after these compartments are depressurized. Otherwise, if the traditional fire suppression system is first deployed the extinguishing agent will be forced out of the airplane and what agent remains, if any, will be too diluted to be effective. Thus, there is an exposure to a growing fire during the time to depressurize the aircraft and for the aircraft to reach a cabin altitude where there is insufficient oxygen to support a fire.

The aforementioned problems and needs similarly apply to many other situations where fire protection is a concern. For example, wind turbines have battery storage and mechanical compartments at risk of starting a fire within the wind turbine. Storage units and facilities, particularly battery storage units, are also susceptible to fires. Such units and facilities are commonly used to house a large number of batteries configured for storing the energy generated by wind turbines and solar panels. Thus, a need exists for a fire suppression system capable of suppressing fires started in these wind turbines, storage units and facilities along with many other types of accessible or inaccessible fire zones.

BRIEF SUMMARY OF THE INVENTION

The present invention is directed toward a fire suppression system that includes a system for discharging a two-part foam fire suppressant that will fight a fire through oxygen deprivation and char formation and/or the formation of an intumescent layer capabilities. The present invention generally includes a first foam component in a container and under pressure, and a second foam component in a container and under pressure. The present invention further includes a smoke/heat detector in electronic communication with a triggering device that acts to discharge the first and second components simultaneously. The present invention is configured to allow for the foam components to be discharged at different pressures and velocities to result in the desired component mixture ratio. The two components are mixed in a mixing conduit and travel through at least one discharge conduit and the liquid mixture is sprayed out through at least one nozzle wherein the foam expands and cures into a substantially rigid foam.

The fire suppression system of the present invention has numerous configurations of regulators, valves, and shut-off valves that can be optimized to result in the performance characteristics desired by the operator of the fire suppression system. These valves or regulators may be automatically controlled to result in operation of the system at will or as a result of being triggered by the presences of smoke and or rapid heat change, or by any other triggering mechanism now known or hereafter developed, including an impact switch similar to those used to release automotive airbags during a crash.

The fire suppression system can be used in any type of accessible or inaccessible fire zone, for example and without limitation, battery housings, compartment housings, equipment housings, storage facilities and systems, warehouses, buildings, enclosed spaces, open spaces or any other regions or areas that can be defined as a potential fire zone or plurality of fire sub-zones. For example, the fire suppression system can be configured for use in a wind turbine, battery storage unit or other similar fire zones. The fire suppression system can also be configured and designed to spray and/or distribute the foam in any number of different directions, dimensions or patterns. The fire suppression system can also be configured to distribute the foam to different sub-zones of a certain space, container, building, compartment or the like as described in greater detail below.

An embodiment of the fire suppression system of the present invention may be configured to be self contained in an exterior case approximately the size of a suit case. This embodiment may be used in ULDs carried on airplanes on a case-by-case basis or, it may be used across the board in every ULD depending on the then-current regulations and particular industry standards. Other embodiments may be similarly configured to match the needs of the particular freight moving vehicles or vehicles carrying components that have a unique fire risk including: cars, hybrid or electric cars, over-the-road trucks, boats, trains, barges, planes, vans, or any other vehicle or enclosure used to contain or transport materials.

Embodiments of the fire suppression system of the present invention have distinct advantages and features over current systems as follows: it suppresses fires hidden in ULDs; it suppresses the smoke of a fire in a ULD; it has a long duration of protection once released; the exterior case is hardened against the effects of explosions or damage by projectiles; it can have tracking device to track the use, service, maintenance, and origin information; it does not require FAA certification; it saves weight because it can be used selectively by a carrier on or in only those ULD's considered of highest risk; it saves maintenance and service costs over current systems related to continued airworthiness and disposal of chemicals; it is extremely reliable, safe, and easy to use and requires no crew actions, but is capable of being connected to a monitoring system if desired; it is reusable if it is not otherwise released and is in airworthy condition; it is light weight; it is rugged; it may be configured to have a long shelf-life; it is non-corrosive; it will not freeze in the expected environment of use; the foam may be cleaned up after use using safe methods and solvents; it will not damage the aircraft or other vehicle or its furnishings or structure; it can be used in ULDs on or off the airplane, in storage, or during land or sea transport of cargo in ULDs or other containers; and it is available in sizes to match container volume requirements.

Another advantage of the present invention is the rigid foam system will control a fire for a limited time even if depressurization occurs in the enclosure containing the freight. Because there is an exposure to a growing fire during the time to depressurize the aircraft and for the aircraft to reach a cabin altitude where there is insufficient oxygen to support a fire, the present invention provides effective fire protection during the period of time from the beginning of a fire until reaching a cabin altitude where there is no longer sufficient oxygen for a fire to continue. Further, after a fire event has occurred, the present invention provides effective fire protection during a de-pressurized aircraft's descent when the air density in the affected cargo compartment(s) increases again to the point where a fire may re-ignite and cause further damage were it not for the presence of the present invention Further, once deployed, the present invention provides protection to 1st and second responders because it contains the fire, smoke, and fumes and may prevent or lessen the possibility of an sudden eruption of a dangerous fire or explosion.

Other aspects and advantages of the present invention will be apparent from the following detailed description of the preferred embodiments and the accompanying drawing figures.

BRIEF DESCRIPTION OF THE SEVERAL VIEWS OF THE DRAWING

In the accompanying drawings, which form a part of the specification and are to be read in conjunction therewith in which like reference numerals are used to indicate like or similar parts in the various views.

DETAILED DESCRIPTION OF THE INVENTION

The following description of the invention illustrates specific embodiments in which the invention can be practiced. The embodiments are intended to describe aspects of the invention in sufficient detail to enable those skilled in the art to practice the invention. Other embodiments can be utilized and changes can be made without departing from the scope of the present invention.

Figures 1, 1A:
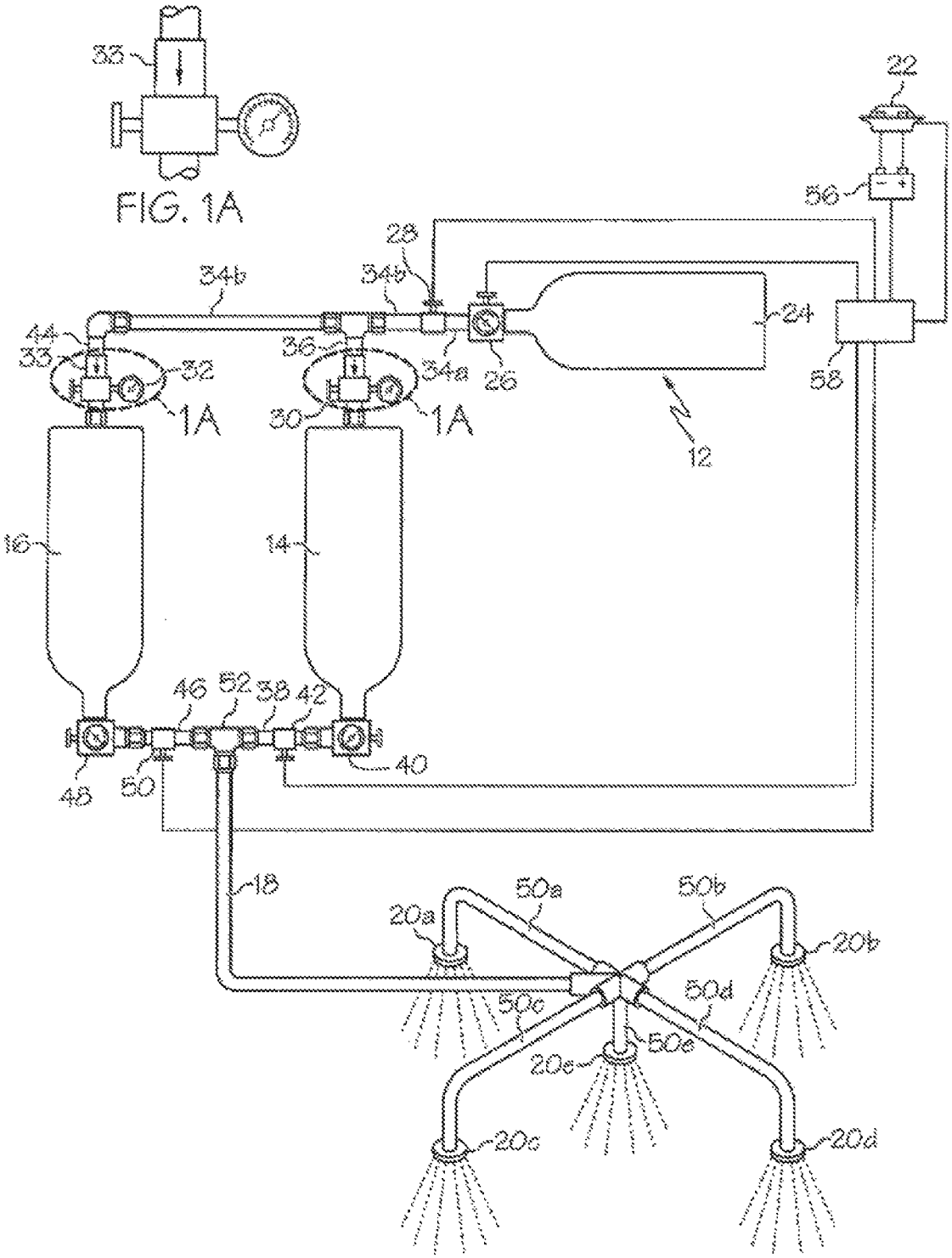
FIG. 1 is a schematic view of one embodiment of the fire suppression system of the present invention.
FIG. 1A is a front view of a valve of the embodiment of the fire suppression system of FIG. 1.

The present invention is directed to a fire suppression system 10 used to disperse a two part fire retarding foam chemical agent. Fire suppression system 10 of the present invention comprises a pressure source 12, a first component tank 14, a second component tank 16, a mixing tube 18, at least one nozzle 20, and a heat/smoke sensor 22. FIG. 1 illustrates an embodiment of the present invention wherein pressure source 12 comprises a compressed gas tank 24. Compressed gas tank 24 includes a volume of gas under pressure so as to be a propellant for the components of tanks 14 and 16. Compressed gas tank 24 may be sized to provide the necessary propelling force for a desired amount of time and/or to propel a certain volume of suppressant in a certain amount of time. Compressed gas tank 24 may be of any material now known or hereafter developed that is used in pressurized tanks, including: steel, aluminum, titanium, brass, copper, any other industrial metal, carbon fiber, or high-strength polymer, or combination thereof. Because embodiments of fire suppression system 10 are intended to be used in freight carriers, weight is a particular concern so lighter weight materials are preferred. However, fire suppression system 10 can also be used in any type of accessible or inaccessible fire zone, for example and without limitation, battery housings, compartment housings, equipment housings, storage facilities and systems, warehouses, buildings, enclosed spaces, open spaces or any other regions or areas that can be defined as a potential fire zone or plurality of fire sub-zones. Compressed gas tank 24 may be filled with any propellant now known or hereafter developed that is used with fire suppression systems including: any noble gas, Argon, HFC-227ea (MH227, FM-200), Novec 1230, HFC-125 (ECARO-25), FS 49 C2, Argonite/IG-55 (ProInert), $CO_2$ carbon dioxide, nitrogen, IG-541 Inergen, IG-100 (NN100), FE-13, FE-227, FE-25, MH227, FM-200, Halons, Halon 1301, Freon 13T1, NAF P-IV, NAF S-III, and Triodide (Trifluoroiodomethane). An alternative embodiment may include first and second component tanks 14 and 16 being internally pressurized using one or more of the above gasses. Moreover, an alternative embodiment may include a gas generator device, such as those used to inflate air bags in automobiles, instead of or in conjunction with the compressed gas tank 24

As shown in FIG. 1, compressed gas tank 24 is in fluid communication with component tanks 14 and 16 through pressure conduit 34. A first variable pressure regulator 26 is removably coupled to gas tank 24 and to a length of pressure conduit 34*a*. A first shut-off valve 28 is coupled to a length of pressure conduit 34*a* and another length of pressure conduit 34*b*. A first tank pressure conduit 36 extends off of length 34*b* toward first component tank 14 and is in fluid communication with first component tank 14. A second variable pressure regulator 30 is operably coupled to first tank pressure conduit 36 to regulate the flow and pressure of gas from tank 24 into first component tank 14. As shown, a second tank pressure conduit 44 extends off of length 34*b* toward second component tank 16 and is in fluid communication with second component tank 16. A third variable pressure regulator 32 is operably coupled to second component tank conduit 44 to regulate the flow and pressure of gas from tank 24 into second component tank 16. As shown in FIG. 1A, one-way check valves 33 may be operably connected between conduit 44 and regulator 32, and between conduit 36 and regulator 30. These check valves prevent the liquid foam agents in containers 14 and 16 from leaking into pressure conduits and hardening and, thereby, preventing blockage of the pressure conduits by the two-part foam mixture.

Second and third variable pressure regulators 30 and 32 allow a user or a technician to individualize the pressure exerted upon the each of the components A and B of a fire suppressing foam. This feature allows one system to be used for any number of fire suppression foams because the variable pressure combinations allows a technician or user to set the pressure for each tank to provide the desired mixture proportions to result in a foam that has the desired physical properties when cured. For example, many two-part foams have a 50-50 mix rate and some have a 55-45, 60-40, 70-30, or other mix rate. In many cases, when components are required to mix at a 50-50 rate, the pressures will be substantially the same. However, there may be cases each component may have such a different viscosity and each component requires different pressures to be mixed to a 50-50 ratio. Moreover, the expanded foam resulting from two components may have different physical properties by varying the mixture proportion. For example, expanding foam may be substantially rigid using a 50-50 mixture proportion and may be slightly elastic when using a 60-40 mixture proportion. Therefore, the system of the present invention is configured to allow users and technicians to best optimize the performance of system 10 by allowing each tank 14 and 16 to be pressurized at different pressures to obtain different flow rates thereby controlling the mixing rate.

Alternatively, in-line fixed area orifices (not shown) within the conduit can be used as a pressure regulator to regulate pressure and/or flow depending on the pressure used. The orifices can be the same size and operating under a certain pressure to provide an equal flow of part A and B, or the orifices may be of different areas to result in different flow rates from the component tanks to create the desired component mixing ratio as further described above.

First and second component tanks 14 and 16 are configured to each contain one part of a two-part fire suppressing foam that is to be distributed using the system of the present invention to suppress and extinguish fires. For example, first component tank 14 contains part A and second component tank contains part B. First and second component tanks can be sized to provide the amount of particular component desired to provide fire suppression for a certain amount of time and/or a certain volume of container. Component tanks 14 and 16 may be of any material now known or hereafter developed that is used in pressurized tanks, including: steel, aluminum, titanium, brass, copper, any other industrial metal, carbon fiber, or high-strength polymer.

The foam may be a two-part urethane foam that forms a substantially rigid closed-cell foam. The foam has fire-resistant and insulative properties when fully cured. Moreover, the foam shall prevent air from passing through the foam and should form a substantially leak-proof barrier on the items it is applied to.

Fire suppression system 10 also includes a first outflow conduit 38 in fluid communication with first component tank 14. A first outflow pressure gauge/regulator 40 is operably connected to outflow conduit 38 and component tank 14. The pressure gauge/regulator 40 will most often be simply a pressure gauge when a separate pressure source 12 such as pressure tank 24 is used in the system. A pressure regulator 40 may be used when component tanks 14 and 16 are internally pressurized so that the user can control and set the outflow pressure. A second shut-off valve 42 is also operably connected to outflow conduit 38. Similarly, fire suppression system 10 also includes a second outflow conduit 46 in fluid communication with second component tank 16. A second outflow pressure gauge/regulator 48 is operably connected to outflow conduit 46 and component tank 16. A third shut-off valve 50 is also operably connected to outflow conduit 46. A person of skill in the art will appreciate that the particular order of regulator and/or shut-off valves along the fluid conduits can be selected by a person of skill in the art to maximize the particular configuration of the fire suppression system. Thus, the shut-off valves may be before the regulators in some embodiments.

Shut-off valves 42 and 50 prevent the foam components from entering the mixing conduit 18. The shut-off valves 42 and 50 may be opened or closed manually or using a control system. One embodiment of the present invention includes shut-off valves 42 and 50 being servo valves configured to be electronically triggered open or closed. Another embodiment includes shut-off valves 42 and 50 being manual valves having an open and a closed position. Yet another embodiment includes shut-off valves 42 and 50 opening automatically under a certain pressure threshold, so under normal storage and use conditions, the valves would be closed and upon applying the pressure from pressure tank 24, the valves would open to allow flow therethrough. Yet another embodiment includes a squib on the tank 14, 16, or 24 or incorporated into a valve or regulator that breaks a rupture disk releasing the contents of the tank. In addition to the shut-off valves and variable pressure regulators being manual and set and adjusted by hand, all shut-off valves and variable pressure regulators used in system 10 may include servo mechanisms or a squib that breaks a rupture disk that are configured to be controlled, open, closed or adjusted using electronic controls, or alternatively include other method now known or hereafter developed to selectively release contents of a tank upon the occurrence of a triggering event.

As further shown in FIG. 1, first component outflow pipe 38 and second component outflow pipe 46 meet a junction 52 and the flow of both components are directed into component mixing pipe 18. First and second components are pressurized such that when they combine and flow through mixing conduit 18 they are mixed as a result of turbulent flow within the conduit so that the foam will cure as intended. Alternatively, there may be inserts within mixing pipe 18 that increase the turbulence in the pipe and/or disrupts the flow such that the proper mixing takes place.

The mixed combination of first component and second component flows through mixing conduit 18 into one or more distribution conduit 50. Distribution conduit 50 is in fluid communication with mixing conduit 18 and nozzles 20. Distribution conduit 50 allows the mixed components of the foam to flow from mixing conduit 18 therethrough to exit out of the system 10 of the present invention and out of at least one nozzle 20. One embodiment includes plural-component nozzles 20 being about 3 inches in diameter and about 1 inch thick. An embodiment may include nozzle 20 having three (3) tubes connected to it, i.e. for the first foam component, the second foam component and for the gas used to froth the mixture of components created at the nozzles. The frothed mixture of fire retardant foam sprays in a radial direction from multiple holes (not shown) around the circumference of each nozzle 20. So, there may be more than one version of the fire suppression system 10 to accommodate the way the nozzles 20 need to be placed depending upon the vehicle, space, container, or compartment in which the system of the present invention is used. Fire suppression system 10 can also be configured and designed to spray and/or distribute the foam in any number of different directions, dimensions or patterns. Fire suppression system 10 can also be configured to distribute the foam to different sub-zones of a certain space, container, building, compartment or the like as described in greater detail below.

FIG. 1 also illustrates one embodiment of the present invention including a power source 56 and it may also include a control panel 58 wherein the power source 56 powers the heat/smoke sensor 22 and control panel 58. Power source 56 is typically a battery of a type that will provide the adequate load and storage performance as required to power the fire suppression system 10 of the present invention. Power source 56 may be DC electrical power for the device's controls and detection devices provided by rechargeable batteries, such as sealed lead acid or gel cells. The fire suppression system 10 may be configured for re-charging the batteries by including a plug-in and/or the appropriate electrical and power connectors. Control panel 58 may be configured to selectively operate one or more shut-off valves or regulators and may monitor the operating conditions and/or actively control the performance of fire suppression system 10 of the present invention, including the following: ambient temperature, conduit pressures, flow velocity, tank pressures, remaining volume of compressed gas, and remaining volume of foam components A and B. Control panel 58 may contain one or more relays, switches, sensors, processors, memory device, indicator, on-off switch, arm/disarm switch, on/reset switch, an audible alarm, LED indicator lights, or other control device now known or hereafter developed to monitor and/or control the operation of the components of fire suppression system 10 of the present invention. Moreover, control panel 58 may be configured to test smoke detector/heat sensor 22, turn the system 10 "on" or "off", and to determine or indicate the charge level of batteries 56.

Figure 2:
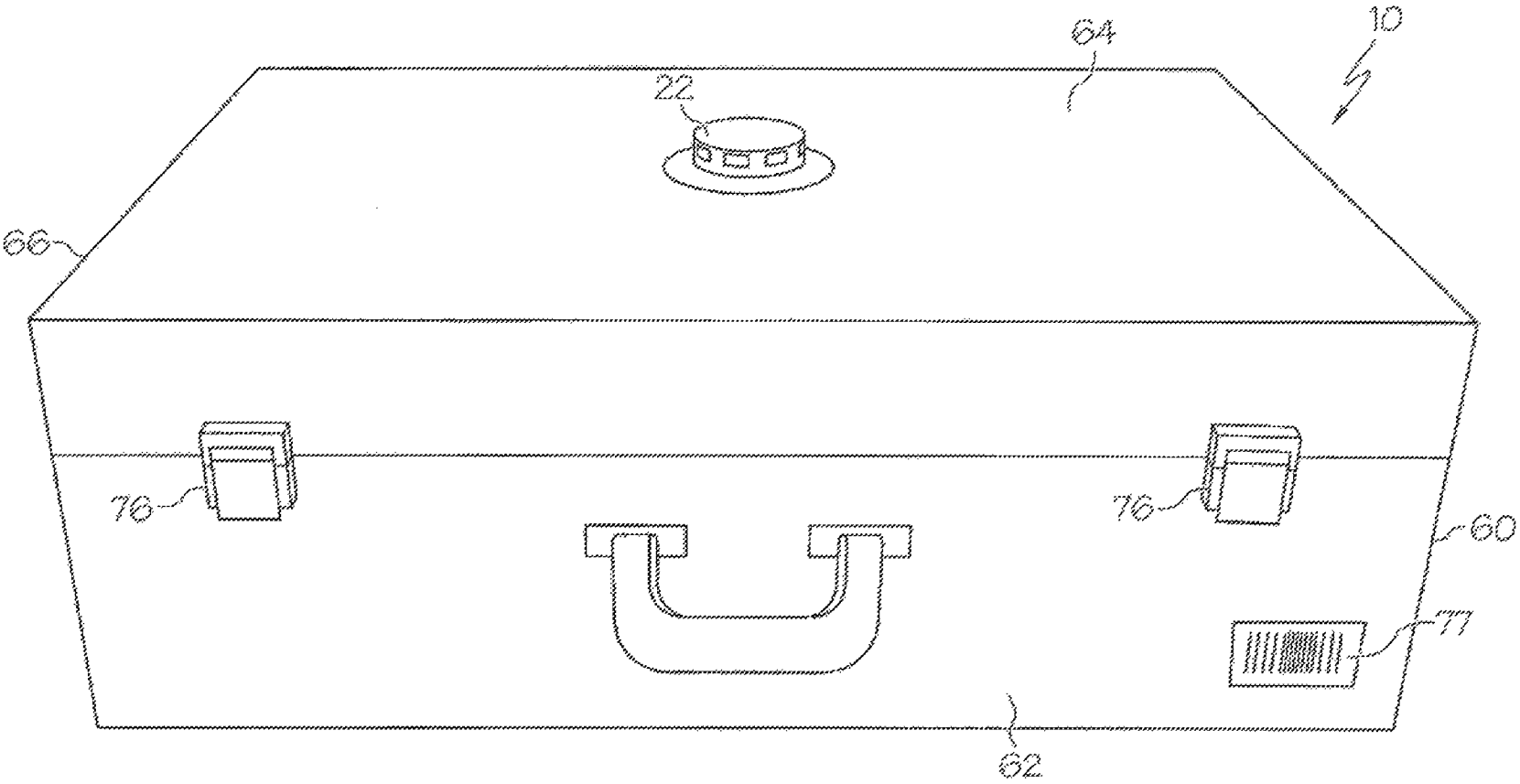
FIG. 2 is a perspective view of one embodiment of the fire suppression system of the present invention.
Figure 3:
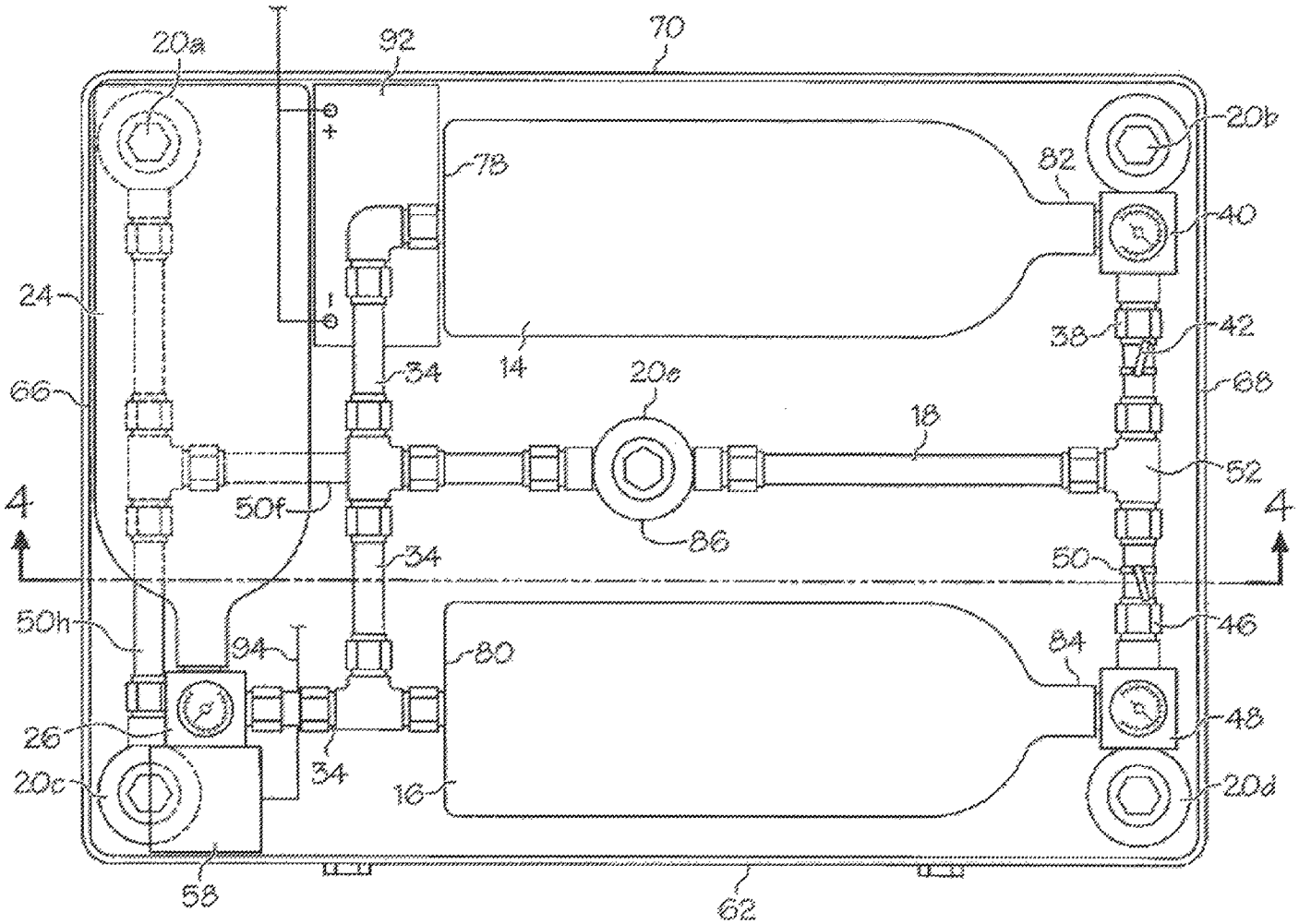
FIG. 3 is a top view of the embodiment of the fire suppression system shown in FIG. 2.
Figure 4:
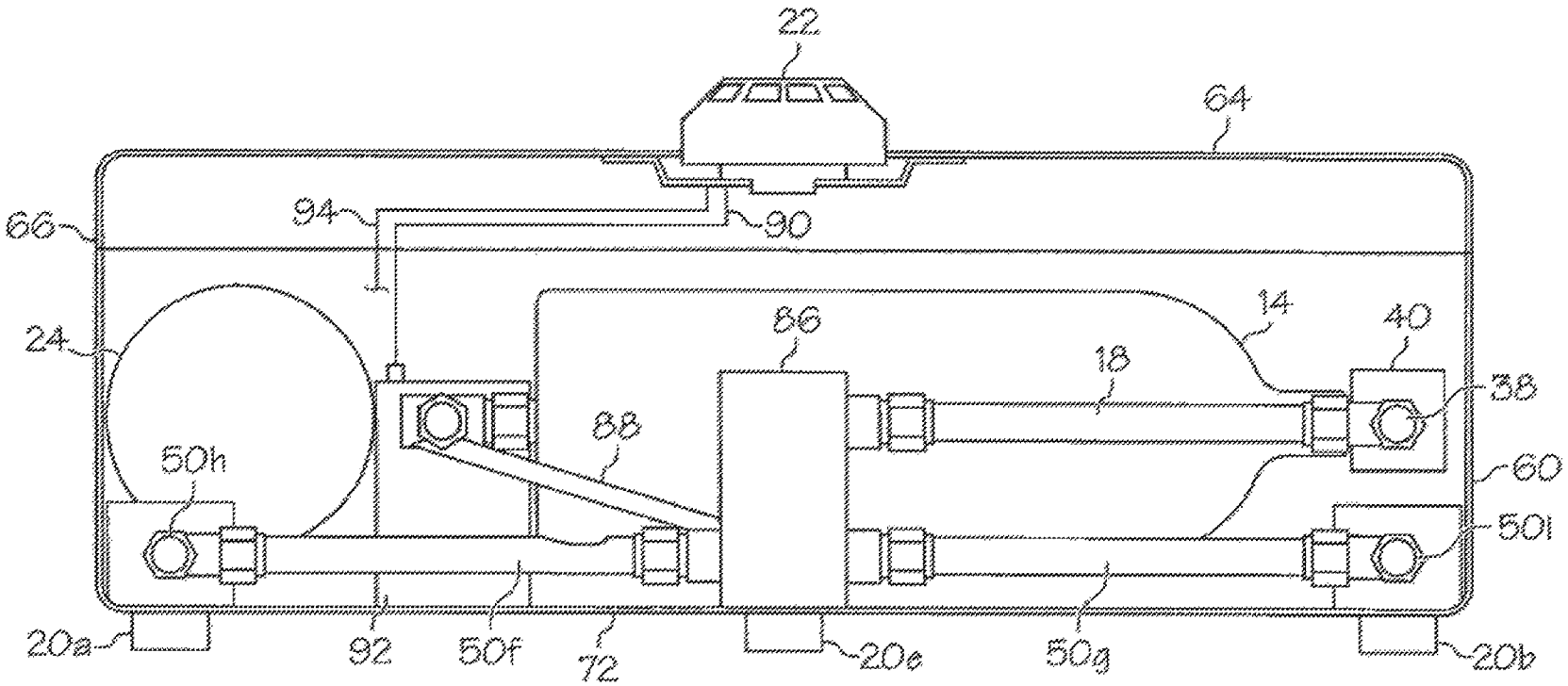
FIG. 4 is a sectional view of the embodiment of the fire suppression system of FIG. 3 along the line 4-4.

As shown in FIGS. 2-4, one embodiment of fire suppression system 10 of the present invention is a portable, re-useable, self-powered, self-contained package which can be selectively placed in or on any ULD. Such an embodiment can also be used in any other type of accessible or inaccessible fire zone, such as without limitation, battery housings, compartment housings, equipment housings, storage facilities and systems, warehouses, buildings, enclosed spaces, open spaces or any other regions or areas that can be defined as a potential fire zone or plurality of fire sub-zones. For example, this embodiment of fire suppression system 10 can be used in a wind turbine and/or a wind turbine battery storage unit as described in greater detail below. This embodiment is designed to detect a fire in both its visible smoke and heat phases for added redundancy, and operates automatically without need for monitoring or any further action by the crew of the airplane or other freight moving vehicle. As shown in FIG. 2, this embodiment of fire suppression system 10 includes an exterior case 60 which includes a front 62, a top lid 64, a first side 66, as second side 68, a back 70 (shown on FIG. 3), and a bottom 72 (shown on FIG. 4). Exterior case 60 may be constructed of steel, aluminum, titanium, carbon fiber, polymer, polyethylene, composite, or any other known industrial material that can be formed or molded to the shape and size similar to a suit case. Exterior case 60 is preferably constructed of a fireproof or fire resistant material having a high temperature threshold and/or melting point. One embodiment includes exterior case 60 being aluminum and having a Kevlar liner (not shown) to increase the resistance of outer case to projectiles that may impact the case upon an explosion or other cause. Depending on the volume of foam required, the size of tanks, and the volume of the exterior case 60, some embodiments may have an overall weight approximately around three (3) pounds per cubic foot of formulated material, but fire suppression system 10 of the present invention shall be any weight required to provide all desired components and configurations described herein. One embodiment of the present invention is configured to suppress fires in a typical ULD having a volume of approximately one-hundred twenty (120) cubic feet. In this case to have enough liquid chemical to protect that much volume, the weight of each part of the chemical will be about twenty (20) pounds. In this example the total weight of the fire suppression system 10 is to be around sixty (60) to seventy (70) pounds.

Exterior case 60 may also include a handle to carry the case and one or more latches 76 or other closure mechanism as shown in FIG. 2. Latches 76 may be lockable and exterior case 60 may be sealed by technicians to ensure the contents of the exterior cases 60 are not tampered with. FIG. 2 also shows how smoke/heat detector 22 may be configured and coupled to lid 64 to allow the detection of smoke or heat outside the exterior case 60. Moreover, exterior case 60 or other component of fire suppression system 10 of the present invention may include a tracking device 77 coupled to a component of fire suppression device 10 inside or outside of exterior case 60. Tracking device may be any tracking device used with any tracking system now known or hereafter developed used to track components of an inventory and its status including bar codes (one-dimensional, two-dimensional, quick response (QR) codes, or other known inventory tracking codes), or microchips like those used for pets that transmit a signal when activated or other similar package tracking system. Tracking device 77 allows a user or owner to track the use, service, maintenance, and origin information of the fire suppression system 10. The tracking device may also be in electronic communication with control panel 58 and when scanned can convey the real-time operational status of one or more components of the fire suppressions system of the present invention.

Now turning to FIG. 3, the inside of exterior case 60 is shown containing the components of fire suppression system 10 therein. Pressure source 12 is compressed gas tank 24 which orientated in its long direction substantially from back 70 to front 62 proximate first side 66. First variable pressure regulator 26 is coupled to and in fluid communication with tank 24 as shown. Pressure conduit 34 extends away from pressure regulator 26 and extends to both an inlet end 78 of first component tank 14 and an inlet end 80 of second component tank 16. Pressure conduit 34 may include a check valve proximate inlet ends 78 and 80 to prevent the contents of component tanks 14 and 16 from backing up into pressure conduit and unintentionally mixing thereby clogging up the system.

First component tank 14 contains a first component of a two-part foam. The pressurized gas from gas tank 24 flowing through pressure conduit 34 applies a pressure on the first foam component such that when pressure gauge/regulator valve 40 is open, the first component exits an outflow end 82 of first component tank 14 into outflow conduit 38. A shut-off valve 42 may be coupled to outflow conduit 38 as shown. Shut-off valve 42 may be used to prevent the first foam component from entering the mixing conduit 18.

Similarly, second component tank 16 contains a second component of a two-part fire retarding foam chemical agent. The pressurized gas from gas tank 24 flowing through pressure conduit 34 applies a pressure on the second foam component such that when pressure gauge/regulator valve 48 is open, the second component exits an outflow end 84 of second component tank 16 into outflow conduit 46. A shut-off valve 50 may be coupled to outflow conduit 46 as shown. Shut-off valve 50 may be used to prevent the second foam component from entering the mixing conduit 18.

With shut-off valves 42 and 50 being open and both the first component and second component of the foam being under pressure, the two components of the foam will mix at junction 52 and be propelled through mixing conduit 18 wherein the two components will sufficiently mix through the turbulent flow in the pipe, an insert (not shown) in mixing conduit 18 that promotes mixing of the components, or a combination thereof. Mixing conduit 18 is in fluid communication with a central trunk 86. As shown in FIG. 4, central trunk 86 is in fluid communication with mixing conduit 18, distribution channel 50*f*, distribution channel 50*g*, and nozzle 20*e*. The mixed liquid foam travels through mixing conduit 18, into central trunk 86 and out nozzle 20*e*. The mixed liquid foam also travels through distribution channel 50*f* and further into distribution channel 50*h* which distributes the mixed liquid foam components to nozzles 20*a* and 20*c* (as shown in FIG. 3) and out through nozzles 20*a* and 20*c* into the environment. The mixed liquid foam further travels through distribution channel 50*g* into another distribution channel 50*i* which distributes the mixed liquid foam components to nozzles 20*b* and 20*d* (as shown in FIG. 3) and out through nozzles 20*b* and 20*d* into the environment.

In addition to the two part foam, one embodiment of the present invention includes central trunk 86 being configured to distribute the propellant from tank 24 and pressure conduit 34 directly out of nozzle 20*e* and into the environment. As shown in FIG. 4, propellant supply conduit 88 extends from pressure conduit 34 directly to and in fluid communication with central trunk 86. This configuration is particularly useful when the pressurizing gas/propellant is of the type that is used to displace the oxygen in the ULD to assist in the oxygen-starvation of the fire. Moreover, central trunk 86 may also be configured to direct propellant from propellant supply conduit 88 through distribution channels 50*f*, 50*g*, 50*h*, 50*i* and out nozzles 20*a*-20*d*. The additional propellant added at central trunk 86 may assist in frothing the liquid foam as it exits nozzles 20*a*-20*e* to provide a more desirable distribution of the liquid foam throughout the protected volume of a container.

As further shown in FIG. 4, smoke/heat detector 22 may be coupled to lid 64 of exterior case 60 with a portion thereof inside exterior case 60 and a portion thereof outside exterior case 60. The portion outside exterior case 60 is configured to detect the presence of smoke and/or heat. A power supply line 90 extends to smoke/heat detector 22 from battery 92 which is the power source 56 of this embodiment. A signal wire 94 is operably connected to smoke/heat detector 22 and extends to control panel 58 (as shown in FIG. 3) such that smoke/heat detector 22 is in electronic communication with control panel 58. Control panel 58 may be in electronic communication with and configured to trigger a squib or a servo control at one or more regulators 26, 40 and 48 to initiate the release of the two component liquid foam out the nozzles 20 upon a signal from smoke/heat detector 22. In addition, control panel 58 may be in electronic communication with one or more shut-off valves 28, 42 or 50 to open or close the valves depending upon the operating condition. In addition, control panel 58 may be in electronic communication with the regulator 26 to monitor the pressure from pressure source 12 and/or in container 24.

Figure 5:
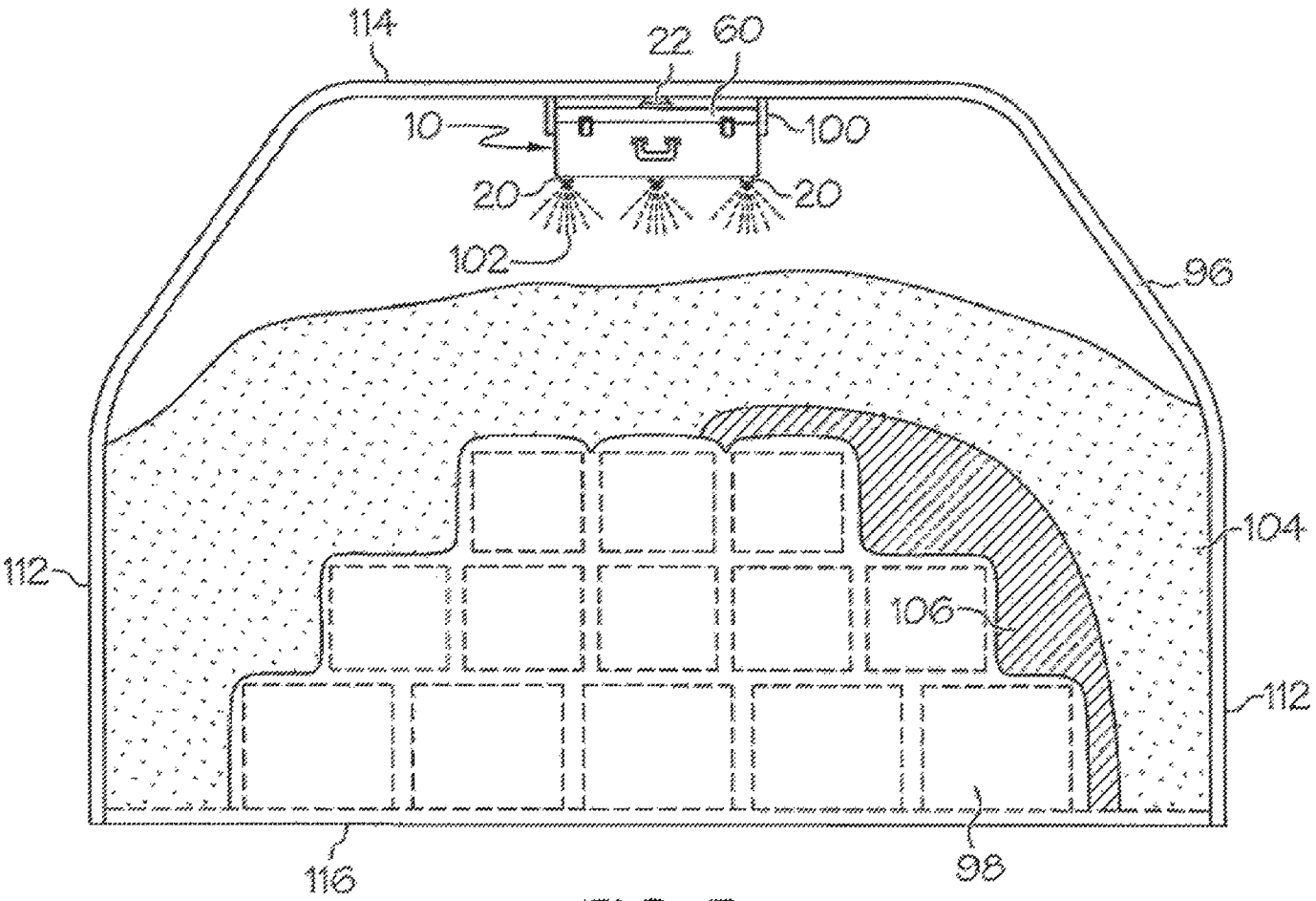
FIG. 5 is a front view of an embodiment of the fire suppression system of the present invention used in a ULD.

In use, fire suppression system 10 of the present invention has many applications and can be configured to effectively suppress fires in a variety of transportation vessels and/or any contained space in which combustible material is stored. Fire suppression system 10 can also be configured and used to effectively suppress fires in various housings, such as battery housings, equipment housings, machinery compartments and the like. In addition, fire suppress system 10 can be configured for use in any other type of fire zone (whether accessible or inaccessible) or plurality of fire sub-zones, for example in a building, facility, or storage unit. While the description herein describes fire suppression system 10 in use with a ULD 96, it is recognized that ULD 96 is merely exemplary and fire suppression system 10 can just as suitably be used in many other suitable environments. FIG. 5 shows an embodiment of fire suppression system 10 housed in exterior case 60 used in a ULD 96 that contains freight transported in airplanes. Exterior case 60 is suspended or mounted to ULD 96 using a bracket 100 or other mounting method now known or hereafter developed, including straps, latches, ratcheting tie-downs, bungee, elastic or rubber cords, or any other coupling mechanism now known or hereafter developed. Exterior case 60 and fire suppression 10 is generally mounted above the cargo as shown and smoke/heat detector 22 may be above the exterior case 60 as shown. Exterior case 60 may further include D-rings, housings, or other components mounted on the outside of exterior case 60 to facilitate mounting exterior case 60 in ULD 96 in a configuration similar to that shown.

Fire suppression system 10 can be placed in individual ULDs that contain freight that includes material posing a spontaneous fire risk such as lithium batteries or placed in every ULD 96 on the plane. In another embodiment not shown, fire suppression system 10 and exterior case 60 may be placed on top of ULD 96 wherein a seal is around an opening in the device's case and a matching hole in the top of ULD 96. The seal conducts smoke and heat from a fire inside ULD 96 into the device's smoke/heat detector 22. When placed on top of ULD 96 there are also matching holes in top 114 of ULD 96 for nozzles 20*a*-*d*.

If a fire begins in ULD 96, smoke will begin to be put-off by the smoldering fire. Smoke detector 22 may detect the presence of smoke in the second phase of the fire and if smoke/heat detector 22 does not detect the smoke, then it is also configured to detect heat put off in the third phase of the fire. Upon detection of either smoke or heat, smoke/heat detector 22 sends a signal to control panel 58 or directly to a regulator 26, 40 or 48 or shut-off valve 28, 42 or 50 depending upon the configuration of fire suppression system. The signal sent by smoke/heat detector 22 triggers the release of propellant from pressure source 12 (tank 24 in one embodiment) thereby effectuating the release of the first foam component from first component tank 14 and the second foam component from second component tank 16. The smoke/heat detector 22 or the control panel 58 may send a signal to the crew of the airplane or other transport vehicle to notify them of the presence of smoke and/or heat, operation of the system 10, or status of system 10.

Figure 6:
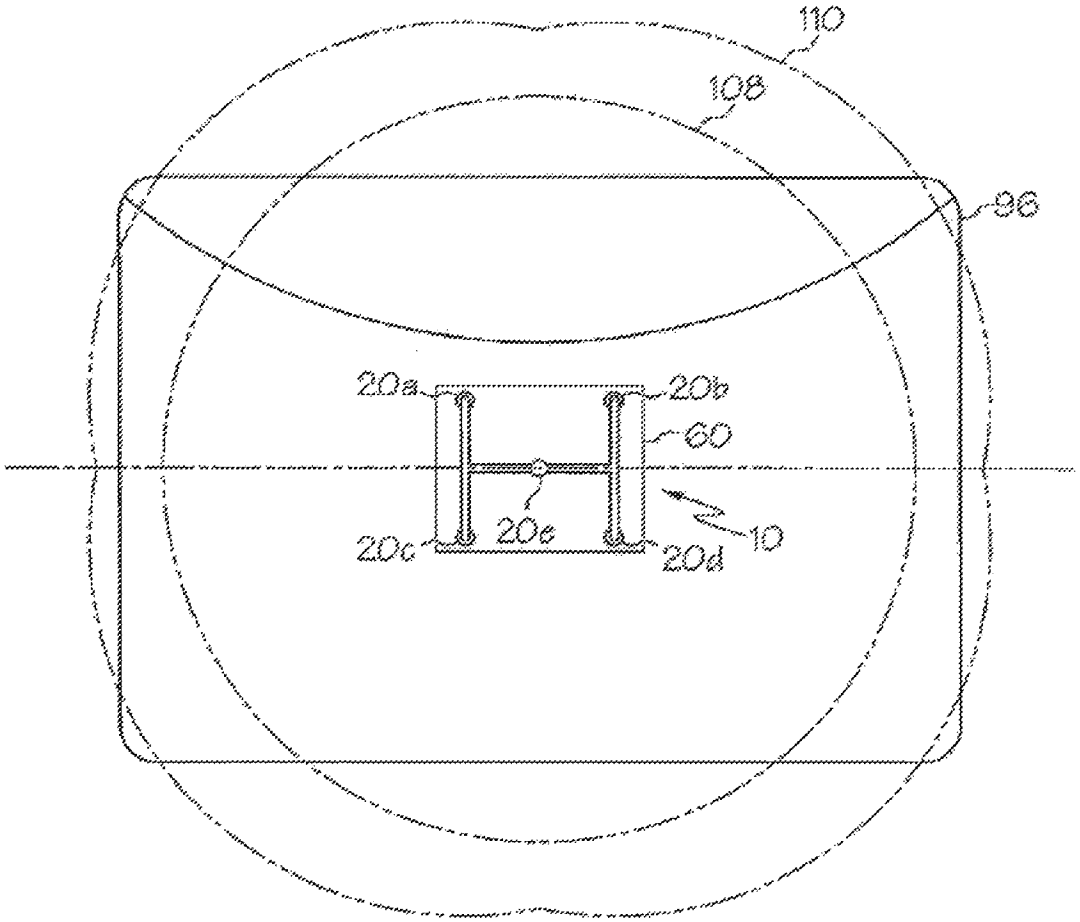
FIG. 6 is a top view of the fire suppressant coverage extents of the embodiment of the fire suppression system of FIG. 5.

Once the release of the two foam components is triggered and initiated, the two components mix in mixing pipe 18 and travel through central trunk 86 and out distribution channels 50*f*-*i* and out nozzles 20*a*-*e* in a spray pattern 102. FIG. 6 shows a representative coverage area of liquid foam sprayed out of nozzles 20*a*-*e* in one embodiment of the present invention. Line 108 represents the approximate extent of spray coverage of the liquid foam components exiting center nozzle 20*e*. Line 110 represents the approximate extent of spray coverage of the liquid foam components exiting corner nozzles 20*a*-*d*. In addition to the liquid foam components, one embodiment includes propellant being released directly out of one or more of nozzles 20*a-e* to assist in oxygen deprivation.

Now turning back to FIG. 5, when sprayed, the two component foam fire suppressant acts to seal ULD 96 and to achieve three objectives: (1) deprive the cargo fire of oxygen resulting in suffocating the fire; (2) extinguish the fire or greatly reduce the fire by using the expandable foam barrier through a char formation/intumescence chemical reaction; and (3) suppress and trap the heat and smoke from the burning material within ULD 96.

As shown, upon triggering of fire suppression system 10 upon the presence of smoke and/or heat, the two-component foam system into ULD 96 during the smoldering or early stage of a fire in ULD 96 so that the liquid material can begin to expand into rigid foam 104 covering as much surface area as possible. The more foam material that can be sprayed the better because it forms a more uniform, homogeneous and thicker foam layer resulting in increased fire suppression protection. FIG. 5 illustrates a well formed thick layer of foam 104 over the freight 98. The sprayed liquid foam material will then contact the substrate or surface of the cargo compartment vertically AND horizontally. Then, it will begin to turn into expandable rigid foam layer 104 within seconds of being released and distributed throughout ULD 96. It is desirable that the two-component foam system sprays out as a frothed liquid because this allows the sprayed material to reach maximum surface coverage between the packages and walls 112, a floor 116, and a ceiling 114 of ULD 96.

When the two-component material has been sprayed and has formed into rigid foam then the flame and heat retardant protection begins through the char formation/intumescence chemical action of the cured foam. As shown in FIG. 5, a portion of foam layer 104 exposed to flame or high heat may form a char formation 106 that has similar or improved insulative and fire resistant properties to the foam itself. The foam blankets the surface of the burning material thus providing another oxygen-starvation component. Foam layer 104 acts as a thick shell to suffocate the fire and trapping the heat and smoke inside ULD 96. If the fire is not immediately extinguished then the next phase of suppression takes place in the manner of char formation 106. The rigid foam layer 104 will interact with the fire causing a carbonaceous char layer 106 to form on the foam layer surface. Char layer 106 is much harder to burn than the foam layer 104 and prevents further growth of the fire. In addition to, or in place of char layer 106, the foam may exhibit intumescence characteristics wherein the foam adjacent to the heat and/or flame swells thereby further encroaching on the fire to reduce the volume of air adjacent to the fire. Foam layer 104 may not put the fire out completely but, at the least, it will contain and suppress the fire by greatly reducing the fire to a smolder, provided that the foam layer 104 has formed on and around the package and the inside of ULD 96.

Figure 7:
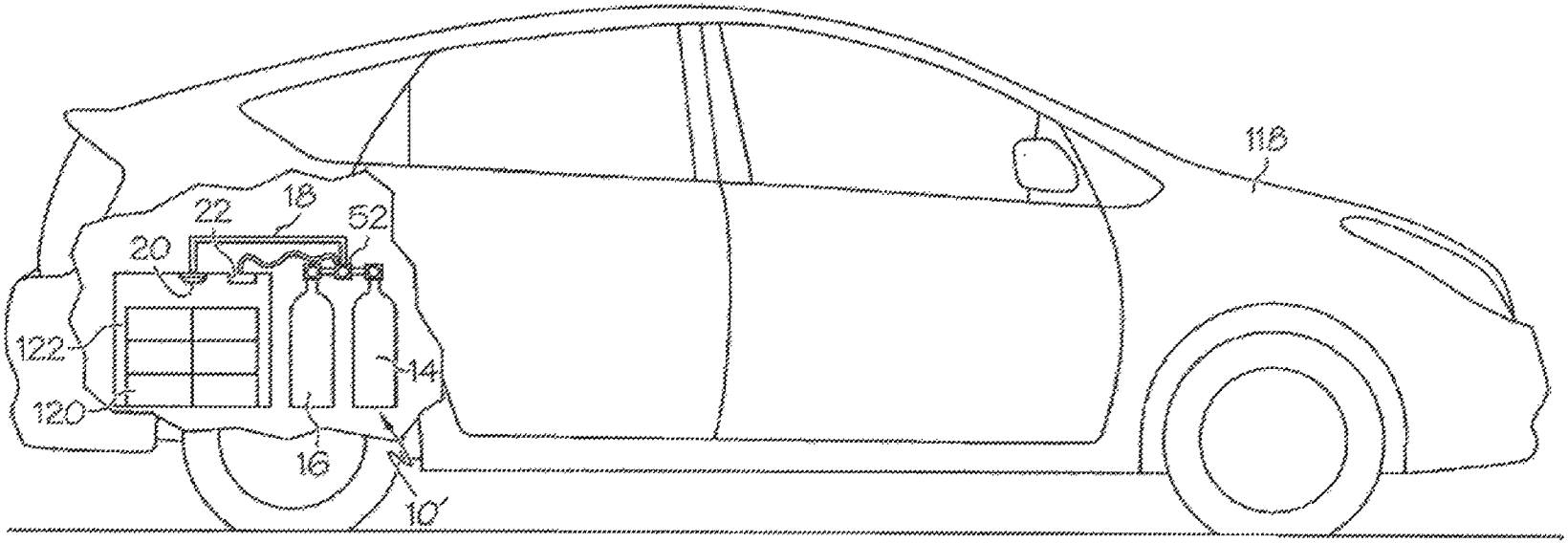
FIG. 7 is a side view of a hybrid or electric vehicle equipped with an embodiment of the fire suppression system of the present invention.

FIG. 7 illustrates an embodiment of fire suppression system 10 as applied to an electric or hybrid car 118. Fire suppression system 10 is configured to suppress fires due to the car's lithium battery pack 120 in battery enclosure 122. As the numbers of hybrid or electric cars increase, the shortcomings in the designs will further present themselves. There have already been instances wherein battery pack 120 of car 118 has burst into flames shortly after a collision, particularly during certain side impact crashes. Battery pack 120 is generally housed in the car's battery enclosure 122 which may protect the battery pack in some instances. However, in the event enclosure 122 is damaged along with battery pack 120, a damaging fire may spread.

An embodiment of the fire suppression system 10' of the present invention will act as a fire suppressant in such instances. As shown, embodiment 10' includes first component container 14 containing a first foam component and second component container 16 containing a second foam component wherein the component tanks 14 and 16 are pre-pressurized. First component container 14 and second component container 16 may, alternatively, be connected to a gas generator(s) controlled and triggered by sensors such as impact switches, smoke or heat detectors, or the like. This embodiment further includes a junction 52 that includes a servo valve to allow the flow from both component containers 14 and 16 when triggered. Smoke/heat detector 22 operably connected to battery enclosure 122 and is in electronic communication with junction 52. When smoke/heat detector senses the presence of smoke or heat in enclosure 122, it triggers valve in junction 52 whereby first and second component are released, pass through junction 52 into mixing pipe 18 and out nozzle 20 thereby filling enclosure 122 and suppressing any fire resulting from damage or disturbance of battery pack 120.

Figure 8:
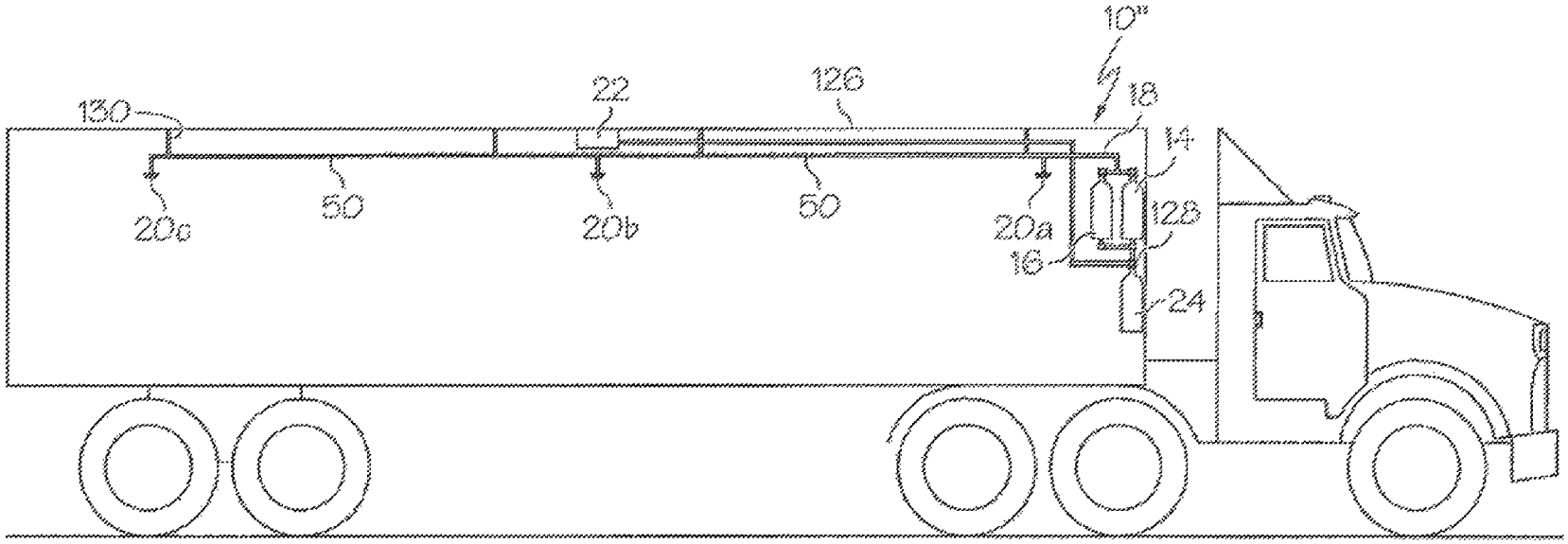
FIG. 8 is a side view of an over-the-road truck and trailer equipped with an embodiment of the fire suppression system of the present invention.

FIG. 8 shows another embodiment of the fire suppression system 10" of the present invention. Fire suppression system 10" is installed in the cargo hold of a delivery truck or over-the-road tractor trailer. This embodiment includes first component container 14 containing a first foam component and second component container 16 containing a second foam component wherein the component tanks 14 and 16 are in fluid communication with pressure tank 24 or gas generator(s). The containers 14 and 15 are similar to one-hundred thirty-six (136) cubic inch fire extinguisher container and have a hexagonal discharge heads attached thereto. Such containers and hexagonal discharge heads are known to a person of skill in the art. This embodiment further includes an electrical squib-operated rupture disk valve 128 in discharge head on pressure tank 24. Smoke/heat detector 22 operably connected to trailer 126 and configured to sense smoke or heat increases in trailer 126. Smoke/heat detector 22 is in electronic communication with squib-operated rupture disk 128. When smoke/heat detector senses the presence of smoke or heat in trailer 126, it triggers squib-operated rupture disk 128 thereby releasing propellant or triggering a gas generator. Propellant pressurizes first and second components in tanks 14 and 16 respectively activating a pressure sensitive valve or rupture disk whereby first and second component are released into mixing pipe 18 and out of nozzle 20*a* continuing through distribution channel 50 and out of nozzles 20*b* and 20*c* thereby covering cargo and substantially filling trailer to extinguish and/or suppress any fire resulting from damage or disturbance of cargo. Distribution channel 50 may be coupled to trailer 126 using one or more brackets or straps 130 as known in the art.

Figure 9:
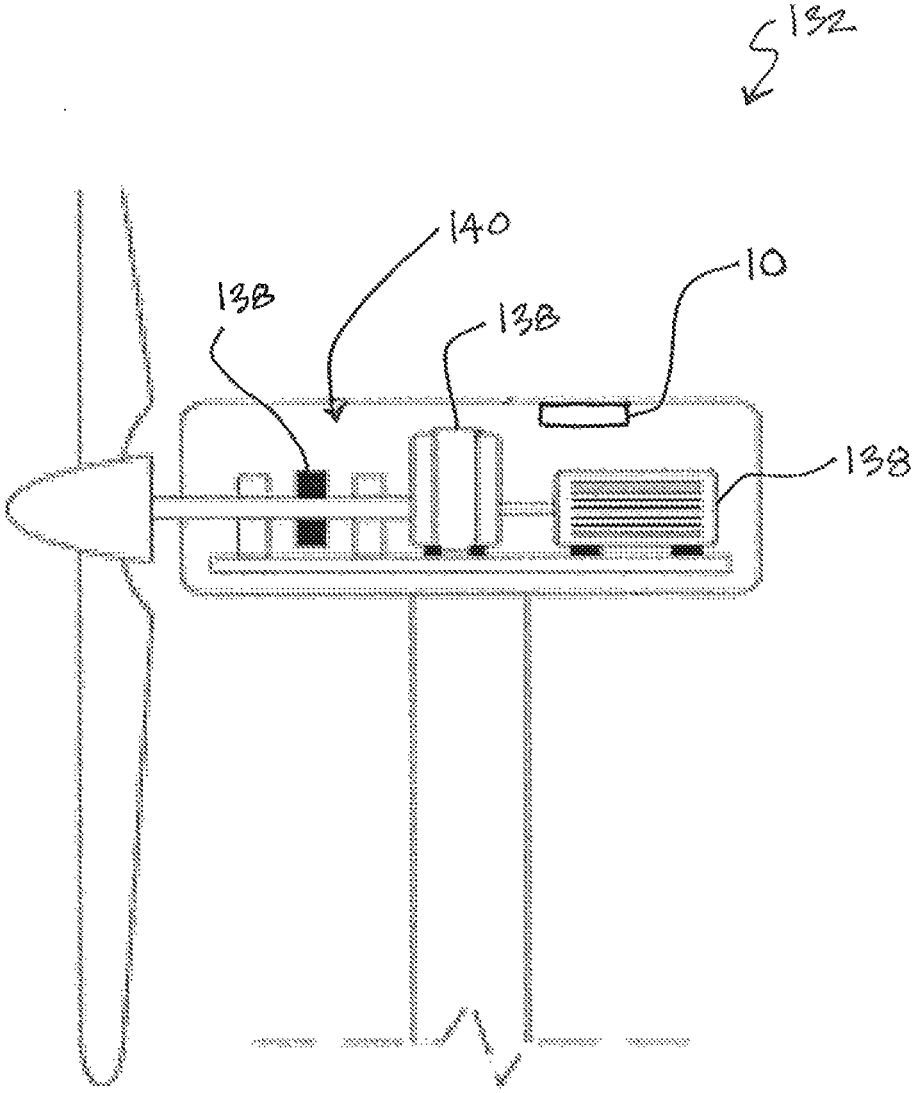
FIG. 9 is a perspective view of a wind turbine equipped with an embodiment of the fire suppression system of the present invention.
Figure 10:
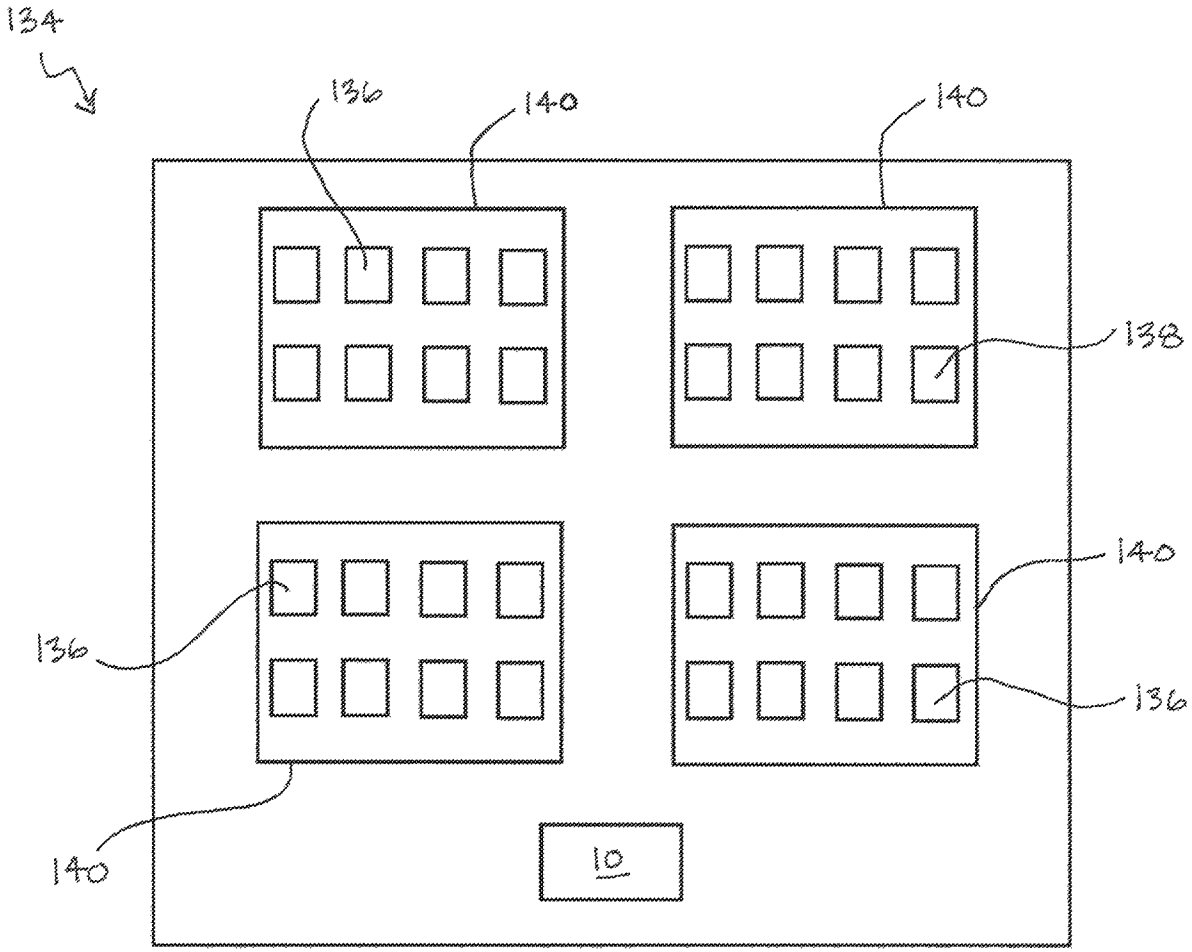
FIG. 10 is a diagrammatic view of a battery storage unit equipped with an embodiment of the fire suppression system of the present invention.

FIG. 9 illustrates an embodiment of fire suppression system 10 as applied to a wind turbine 132. Fire suppression system 10 according to this embodiment can be configured to suppress fires within a compartment or housing 140 inside the wind turbine 132, such as due to a battery fire, electrical, mechanical or other fire occurring within wind turbine 132 or an adjacent battery storage facility 134 (as schematically shown in FIG. 10) holding one or more batteries 136 that store energy created by wind turbines 132. Due to the major expense of such wind turbines 132 and battery storage facilities 134 and the environmental concerns resulting from the burning of batteries 136 or mechanical components 138 within wind turbines 132, fire suppression device 10 can greatly reduce the risk of damage to the wind turbines 132 and storage facilities 134 and increase the durability of wind turbines 132. There have already been instances wherein batteries 136 at a storage facility 134 or mechanical components 138 in a wind turbine 132 have burst into flames shortly causing significant damage to the wind turbines 132, the storage facility 134 and the surrounding environment. Mechanical components 138 within wind turbines 132 are generally stored in one or more compartments or housing 140 inside the wind turbine 132. Such mechanical components 138 can include, without limitation, the hub, gear box, transmission, brake assembly, hydraulic pumps, speed control mechanisms, control boxes, and generators. Batteries 136 are similarly stored in housings, compartments or racks 140 within a storage facility 134. When a fire is started in one or more of these housings, compartments or racks 140, they can become damaged and allow the fire to spread.

Fire suppression system 10, when configured for use in a wind turbine 132 or a storage facility 134 can be configured in a manner similar to that as described above. In such a configuration, fire suppression system 10 can be configured to discharge a two-part foam onto or inside one or more housings, compartments and/or rack 140 within wind turbine 132 and/or storage facility 134 similar to a ULD 96 as described above. As described, fire suppression system 10 can include first and second component tanks 14 and 16, each containing one part of a two-part fire suppression foam that is distributed in a manner described above. The foregoing embodiment can also be similarly used for solar panels that have similar battery storage facilities or units 134.

Such an embodiment of fire suppression system 10 can also include first component container 14 containing a first foam component and second component container 16 containing a second foam component wherein the component tanks 14 and 16 can be pre-pressurized. First component container 14 and second component container 16 may, alternatively, be connected to a gas generator(s) controlled and triggered by sensors such as impact switches, smoke or heat detectors, or the like. Fire suppression system 10 can include a junction 52 that includes a servo valve to allow the flow from both component containers 14 and 16 when triggered. Smoke/heat detector(s) 22 can be operably connected to, positioned within or adjacent to one or more of the housings, compartments or racks 140 and can be in electronic communication with junction 52. When smoke/heat detector or detectors 22 senses the presence of smoke or heat in a housing, compartment or rack 140, it triggers valve in junction 52 whereby first and second component are released, pass through junction 52 into mixing pipe 18 and out nozzle 20 thereby filling housing 140 and suppressing any fire resulting from damage or disturbance of batteries 136, mechanical equipment 138 or the like.

Figure 11:
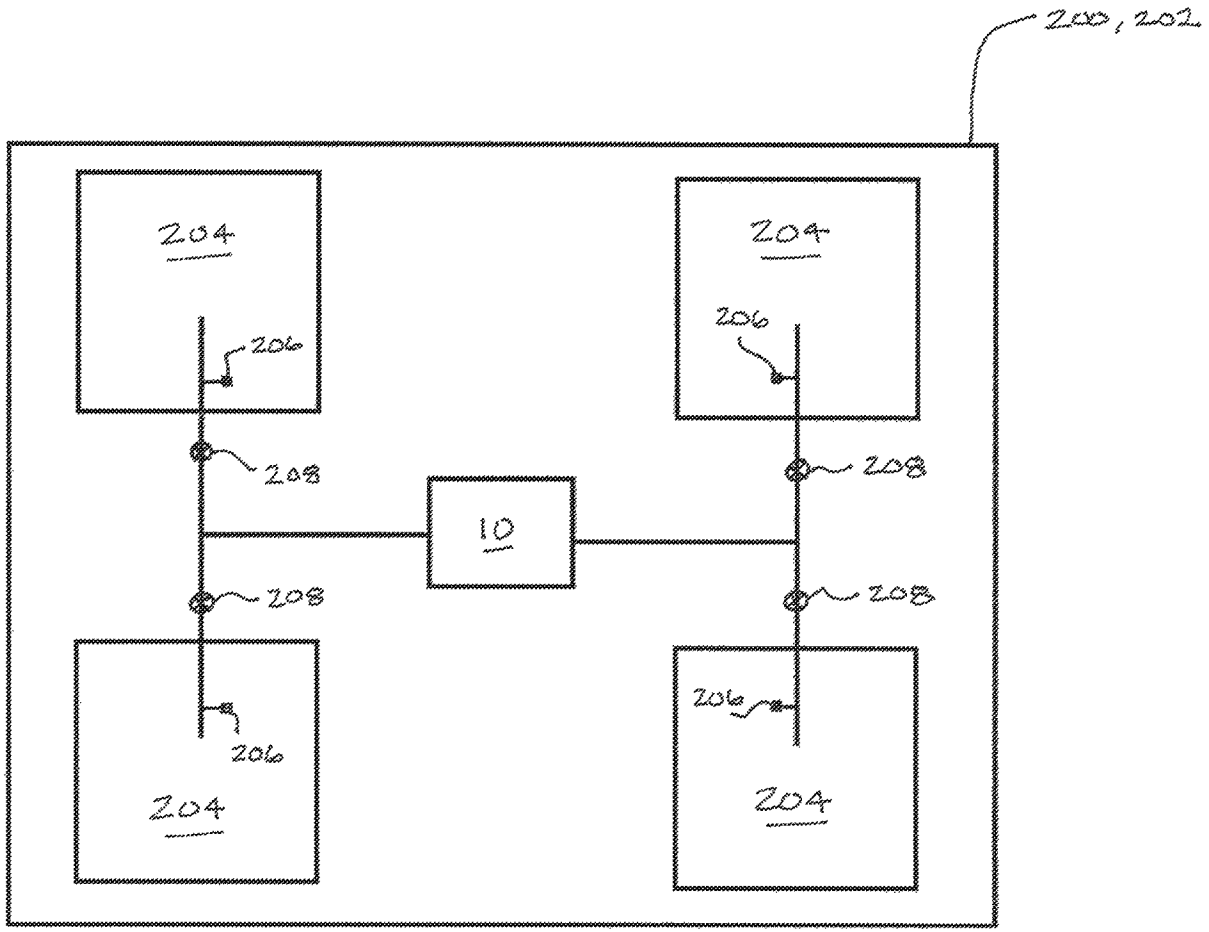
FIG. 11 is a diagrammatic view of a fire zone equipped with an embodiment of the fire suppression system of the present invention.

Turning to FIG. 11, fire suppression system 10 can be configured and used to protect accessible fire zones 200 (such as an open space) or inaccessible fire zones 202 (such as enclosure 122, housing 140 or similar enclosed space or housing). Fire suppression system 10 can be configured to discharge the two-part foam so as to generally cover an entire fire zone 200 or 202, or fire suppression system 10 can be configured to discharge the two-part foam within selective regions or sub-zones 204 of a fire zone 200 or 202. In such an embodiment, fire suppression system 10 can be selectively configured to discharge the foam in a specific sub-zone 204, thereby preserving the contents of the other sub-zones 204 within a fire zone 200 or 202 not affected by a fire. Fire suppression system 10 can have smoke/fire detectors 206 within each sub-zone 204 and each sub-zone 204 can have an associated valve switch 208 to allow the foam to exit into a specific sub-zone 204 only when selected.

For example, wind turbines 132 (and also solar panels) commonly have battery storage units 134 associated therewith for storing the power generated by the wind turbines 132 (or solar panels). Such storage units 134 are commonly configured with multiple battery housings, compartments and/or racks 140 in different regions of the storage unit 134. Accordingly, each of these housings, compartments and/or racks 140 can represent a different sub-zone 204. If a fire is started in one of the sub-zones 204, fire suppression system 10 can be configured to discharge the foam into only the sub-zone 204 effected by the fire. Fire suppression system 10 can also be configured discharge the foam into additional or all the sub-zones 204 by the opening of valves 208.

Fire suppression system 10 can also be configured with first and second component tanks 14 and 16 for each individual sub-zone 204 or a selected group of sub-zones 204. In such an embodiment, tanks 14 and 16 can be sized and customized for the particular dimensions and needs of a specific sub-zone 204 or selected group of sub-zones 204. This can be advantageous where certain sub-zones 204 require a greater amount of the two-part foam than other sub-zones 204 within a single fire zone 200 or 202. For example, when fire suppression system 10 is configured for use in a wind turbine 132, one or more mechanical components 138 (e.g., the hub, gear box, transmission, brake assembly, hydraulic pumps, speed control mechanisms, control boxes, and generators) can be located within a sub-zone 204, each having a detector 206 and/or switch valve 208 associated therewith. Alternatively, each mechanical component 138 (or sub-zone 204) can have individual component tanks 14 and 16 associated therewith. As a result, fire suppression system can discharge the two-part foam only in the zone where a fire is detected.

There several other functionalities that may be incorporated into the fire suppression of the present invention including: a disarm device that renders the device safe and prevents its operation; a monitoring device that allows for remote control or monitoring of the status and operation of the device using a computer, display device or hand-held device wherein the monitoring device is configured to indicate the conditions and/or status of system 10, which may include whether or not the device has discharged, a fire is sensed, or the pressures and other conditions of the propellant or liquid foam.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

The invention claimed is:

1. A fire suppression system for a fire zone, said fire suppression system comprising:

a case including a bottom and at least one sidewall;

a first component container mounted within said case, said first component container containing a first liquid foam component of a two-part foam;

a second component container mounted within said case, said second container containing a second liquid foam component of said two-part foam;

at least one component release device mounted within said case, said at least one component release device in fluid communication with said first component container and said second component container, said at least one component release device being configured to be selectively capable of releasing said first and second foam components from said first and second component containers;

a fire detector operably connected to said case, said fire detector in electric communication with said at least one component release device, wherein said fire detector electronically signals for the release of said first and said second liquid foam components upon detection of smoke and/or heat;

a propellant in fluid communication with said first and said second foam component wherein the activation of said at least one component release device results in at least one of (i) a unrestrained positive pressure applied upon said first foam component and said second foam component by said propellant thereby causing the exit of said first foam component from said first component container and the exit of said second foam component from said second component container, and (ii) a direct release of said propellant;

a mixing conduit within said case, said mixing conduit in fluid communication with said first component container, said second component container, and said propellant and configured to receive at least one of said first and said second foam components and cause mixing thereof and said propellant; and at least one nozzle operably connected to said case, said at least one nozzle in fluid communication with said mixing conduit and configured to spray at least one of said mixed first and second foam components and said propellant into said fire zone.

2. The fire suppression system of claim 1 wherein said first foam component is pressurized in said first component container and said second foam component is pressurized in said second component container.

3. The fire suppression system of claim 2 wherein said first component container and said second component container are internally pressurized.

4. The fire suppression system of claim 1 further comprising a pressure tank in fluid communication with said first and said second component containers wherein said pressure tank contains a volume of said propellant under positive pressure.

5. The fire suppression system of claim 1 wherein said fire zone is located within a wind turbine.

6. The fire suppression system of claim 1 wherein said fire zone is located within a battery storage unit associated with at least one of a wind turbine and a solar panel.

7. The fire suppression system of claim 1 wherein said fire zone includes a plurality of sub-zones, each sub-zone of said plurality of sub-zones constituting a separately defined space within said fire zone, wherein said at least one nozzle of said fire suppression system comprises a nozzle located within each sub-zone of said plurality of sub-zones, each said nozzle being operably connected to said case and in fluid communication with said mixing conduit, and wherein said fire suppression system is configured for selectively releasing at least one of said mixed first and second foam components and said propellant into a selected sub-zone of said plurality of sub-zones.

8. The fire suppression system of claim 7 wherein said sub-zones comprise at least one of a housing, a compartment and a rack.

9. The fire suppression system of claim 7 wherein said fire suppression system comprises a fire detector located in each of said sub-zones within said plurality of sub-zones, wherein each said fire detector is operably connected to said case.

10. The fire suppression system of claim 2 further comprising a pressure tank in fluid communication with said first and said second component containers wherein said pressure tank contains a volume of said propellant under positive pressure.

11. The fire suppression system of claim 1 further comprising a propellant supply conduit in fluid communication with said at least one nozzle to froth said mixed first and second foam components prior to exiting said at least one nozzle and so that propellant may be released through said at least one nozzle in to said fire zone.

12. The fire suppression system of claim 1 further including a first pressure regulator that controls the pressure at which said first foam component exits said first component container.

13. The fire suppression system of claim 12 further including a second pressure regulator that controls the pressure at which said second foam component exits said second component container.

14. The fire suppression system of claim 1 further comprising a device to monitor at least one of the temperature, pressure, flow velocity and volume of said propellant.

15. The fire suppression system of claim 14 wherein said device is a gauge or a switch.

16. The fire suppression system of claim 1 further comprising a first device to monitor at least one of the temperature, pressure, flow velocity and volume of said first liquid foam component and a second device to monitor at least one of the temperature, pressure, flow velocity and volume of said second liquid foam component.

17. The fire suppression system of claim 1 wherein said at least one component release device is a servo valve or a squib-rupture disk assembly.

18. The fire suppression system of claim 1 further comprising a control panel in electronic communication with said fire suppression system to monitor at least one of the temperature, conduit pressures, flow velocity, container pressures, remaining volume of compressed gas and remaining volume of said first and second foam components of said fire suppression system and relay said at least one of the temperature, conduit pressures, flow velocity, container pressures, remaining volume of compressed gas and remaining volume of said first and second foam components to a display device.

19. The fire suppression system of claim 1 wherein said fire detector detects at least smoke and heat.

20. The fire suppression system of claim 1 wherein the propellant is selected from the group consisting of any noble gas, Argon, HFC-227ea (MH227, FM-200), Novec 1230, HFC-125 (ECARO-25), FS 49 C2, Argonite/IG-55 (ProInert), CO2 carbon dioxide, nitrogen, IG-541 Inergen, IG-100 (NN100), FE-13, FE-227, FE-25, MH227, FM-200, Halons, Halon 1301, Freon 13T1, NAF P-IV, NAF S-III, and Triodide (Trifluoroiodomethane).

21. A removable fire suppression system for a fire zone, said fire suppression system comprising:

an exterior case including a bottom and at least one side defining an interior volume;

a first component container mounted within said interior volume, said first component container containing a first component of a two-part fire retardant agent;

a second component container mounted within said interior volume, said second component container containing a second component of said two-part fire retardant agent;

at least one component release device mounted within said interior volume, said at least one component release device in fluid communication with said first component container and said second component container, said at least one component release device being configured to be selectively capable of releasing at least one of said first and second components from said first and second component containers and a propellant;

a fire detector operably connected to said exterior case, said fire detector in electric communication with said at least one component release device, wherein said fire detector electronically signals for the release of at least one of said first and said second components and said propellant upon detection of smoke and/or heat;

wherein said propellant is in fluid communication with said first and said second components, wherein the activation of said at least one component release device results in at least one of (i) a unrestrained positive pressure applied upon said first component and said second component by said propellant thereby causing the exit of said first component from said first component tank container and the exit of said second component from said second component container and (ii) a direct release of said propellant;

a mixing conduit within said interior volume, said mixing conduit in fluid communication with said first and second component containers and said propellant and configured to receive at least one of said first and said second foam components and cause mixing thereof and said propellant; and at least one nozzle operably connected to said exterior case, said at least one nozzle in fluid communication with said mixing conduit and configured to spray at least one of said mixed first and second components and said propellant into said fire zone.

22. The fire suppression system of claim 21 wherein said first component is pressurized in said first component container and said second component is pressurized in said second component container.

23. The fire suppression system of claim 21 further comprising a pressure tank in fluid communication with said first and said second component containers wherein said pressure tank contains a volume of said propellant under positive pressure.

24. The fire suppression system of claim 21 further including a first pressure regulator that controls the pressure at which said first foam component exits said first component container.

25. The fire suppression system of claim 24 further including a second pressure regulator that controls the pressure at which said second foam component exits said second component container.

26. The fire suppression system of claim 21 wherein, upon exiting said nozzle, said mixed first and second components are configured to cure into a cured two-part foam that forms a char layer when exposed to flames or elevated temperature.

27. The fire suppression system of claim 26 wherein said cured two-part foam has intumescence properties proximate said char layer.

28. The fire suppression system of claim 21 further comprising a device to monitor at least one of the temperature, pressure, flow velocity and volume of said propellant.

29. The fire suppression system of claim 28 wherein said device is a gauge or a switch.

30. The fire suppression system of claim 21 further comprising a first device to monitor at least one of the temperature, pressure, flow velocity and volume of said first component and a second device to monitor at least one of the temperature, pressure, flow velocity and volume of said second component.

31. The fire suppression system of claim 21 further comprising a control panel in electronic communication with said fire suppression system to monitor at least one of the temperature, conduit pressures, flow velocity, container pressures, remaining volume of compressed gas and remaining volume of said first and said second components of said fire suppression system and relay said at least one of the temperature, conduit pressures, flow velocity, container pressures, remaining volume of compressed gas and remaining volume of said first and said second components to a display device.

* * * * *